US006076592A

United States Patent [19]

Grützner

[11] Patent Number: 6,076,592

[45] Date of Patent: Jun. 20, 2000

[54] CURTAIN OPERATING ASSEMBLY

[75] Inventor: Hans Grützner, Kehrsatz, Switzerland

[73] Assignee: Silent Gliss International AG, Gumligen, Switzerland

[21] Appl. No.: 09/146,033

[22] Filed: Sep. 2, 1998

[30] Foreign Application Priority Data

Sep. 25, 1997 [CH] Switzerland ..... 2264/97

[51] Int. Cl.[7] ..... A47H 1/00

[52] U.S. Cl. ..... 160/331; 292/93 A

[58] Field of Search ..... 160/331, 340, 160/341, 344; 192/93 A

[56] References Cited

U.S. PATENT DOCUMENTS

| | | | |
|---|---|---|---|
| 2,105,218 | 1/1938 | Kirby | 192/93 A |
| 2,127,186 | 8/1938 | Perkins | 192/93 A |
| 4,845,321 | 7/1989 | Miki | 160/331 |
| 4,965,498 | 10/1990 | Yokota | 160/331 |
| 4,982,823 | 1/1991 | Yoshida . | |
| 4,995,442 | 2/1991 | Marzec | 160/331 |
| 5,611,386 | 3/1997 | Wang | 160/331 |

FOREIGN PATENT DOCUMENTS

| | | | |
|---|---|---|---|
| 0 282 970 | 9/1988 | European Pat. Off. . | |
| 0 782 833 | 7/1997 | European Pat. Off. . | |
| 458806 | 4/1928 | Germany | 160/331 |
| 1 364 523 | 8/1974 | United Kingdom . | |
| 2 169 189 | 7/1986 | United Kingdom . | |
| 97/42427 | 11/1997 | WIPO . | |

*Primary Examiner*—Blair M. Johnson
*Attorney, Agent, or Firm*—Sughrue, Mion, Zinn, Macpeak & Seas, PLLC

[57] ABSTRACT

A curtain operating assembly has a track 2 with a pulling band 4 and sliding carriages 7, 9. The assembly is also equipped with an electric motor 11 connected to a drive cogwheel 17 and the pulling band. A clutch mechanism allows manual movement of the curtain 8. The drive shaft 33 of the electric motor has an attached claw 22 that may be moved in an axial direction in and out of the drive cogwheel during each rotational direction change of the drive shaft, to thereby engage or disengage the drive shaft.

10 Claims, 3 Drawing Sheets

CURTAIN OPERATING ASSEMBLY

BACKGROUND OF THE INVENTION

This invention relates to a curtain operating assembly that has a track in which a sliding carriage is placed to which the curtain is fastened. The track also has a pulling band that moves the carriages. The assembly is equipped further with an electric motor, which has a cogwheel attached that engages the pulling band, and a clutch mechanism that allows movement of the curtain by hand.

Such a curtain operating assembly, or curtain suspension assembly, is generally known and is predominantly used in up-scaled residences, in office buildings and hotels. Such an assembly is user-friendly since the curtain can be moved by using a pushbutton. A clutch assembly makes manual movement of the curtain possible in addition to the movement by electric motor. Manual operation is necessary especially when curtains are used in office buildings or hotels. It is not apparent for the user in these areas that the curtain is operated by a pushbutton in conjunction with an electric motor and not manually. The uninformed user might therefore try to slide the curtain by hand. However, since the curtain is directly connected to the pulling mechanism of the electric drive, it is blocked and may not be moved by hand. There is the danger that the curtain, the pulling mechanism or parts of the drive mechanism may be damaged, according to the invention. The above-mentioned clutch mechanism makes it possible to move the curtain manually. The ability to move the curtain by hand is absolutely necessary if the curtain has to be moved in an escape route.

An assembly of this type is disclosed in EP-A-0 282 970. In this assembly, the drive mechanism is equipped with a planetary gear that disengages the electric motor from the pulling band and thereby the curtain may be moved freely by hand, if necessary. The disconnecting is accomplished by a brief counter-directional turn of the drive axle of the electric motor. The planetary gear assembly needs a relatively large space and is in many cases difficult to install.

An assembly of the same type is disclosed in EP-A-0 782 833, which also has an electric drive mechanism and which further allows manual movement of the curtain. A carriage is connected through a disengaged clutch mechanism to the drive band to be able to move the curtain manually. The clutch may be disengaged by a powered mechanism located above the curtain area. The clutch is disengaged automatically whenever the electric motor is switched on. The engagement of the clutch is caused by a stud that makes connection with a hole in the drive band. The clutch can tolerate only a relatively low drive force and is therefore not suited for very heavy curtains.

SUMMARY OF THE INVENTION

This invention has the objective to produce a curtain operating assembly of the type mentioned above but which is simpler and operationally safer in construction and which needs relatively little space.

This objective is realized in this type of curtain operating assembly in that the drive shaft of the electric motor has a claw that slides axially and moves in and out of the cogwheel at each rotational direction change of the drive shaft, thereby engaging or disengaging the drive shaft itself. Such a claw may be installed in a very small space and may consist of only a few parts. This claw also makes the transfer of great torque possible and is therefore suited for the movement of very heavy curtains. An especially cost-effective and simple application has been designed in that the claw has a cam to engage or disengage, whereas the drive shaft has a pin extending from each side that comes into contact with the cam-shaped guide. Whenever the electric motor is turned on, the claw is driven into the cogwheel by the rotation of the pin and therefore the cogwheel turns with the electric motor. Whenever the electric motor is turned off, the electric motor turns briefly in the opposite direction and through the corresponding counter-movement of the pin, the claw is pulled back and is thereby disengaged.

As a development of the invention, a non-contact magnetic switch can be installed by which the electric motor is turned off at a particular position of the curtain or carriage, and thereby the electric motor can be turned off without having to be blocked at full power at the end of the traversing distance. Such blocking or stopping is suggested in the assembly according to EP-A-0 282 970. The hereby suggested magnetic switch has essentially the advantage that performance of the curtain operating assembly may be increased by several times over and thereby the moving of very heavy curtains is made possible. The curtain operating assembly allows thereby powered movement of very heavy curtains, which also may be moved manually at any time. Placement and mechanical controls of a reciprocating claw mechanism are extremely simple and cost-effective in comparison to other known control systems.

The space needed for the clutch mechanism is so little that it can be readily fitted inside the drive housing of the track. The drive mechanism may therefore be mounted directly to the drive housing, as it is commonly done.

DETAILED DESCRIPTION OF THE PREFERRED EMBODIMENT

Figure 1:
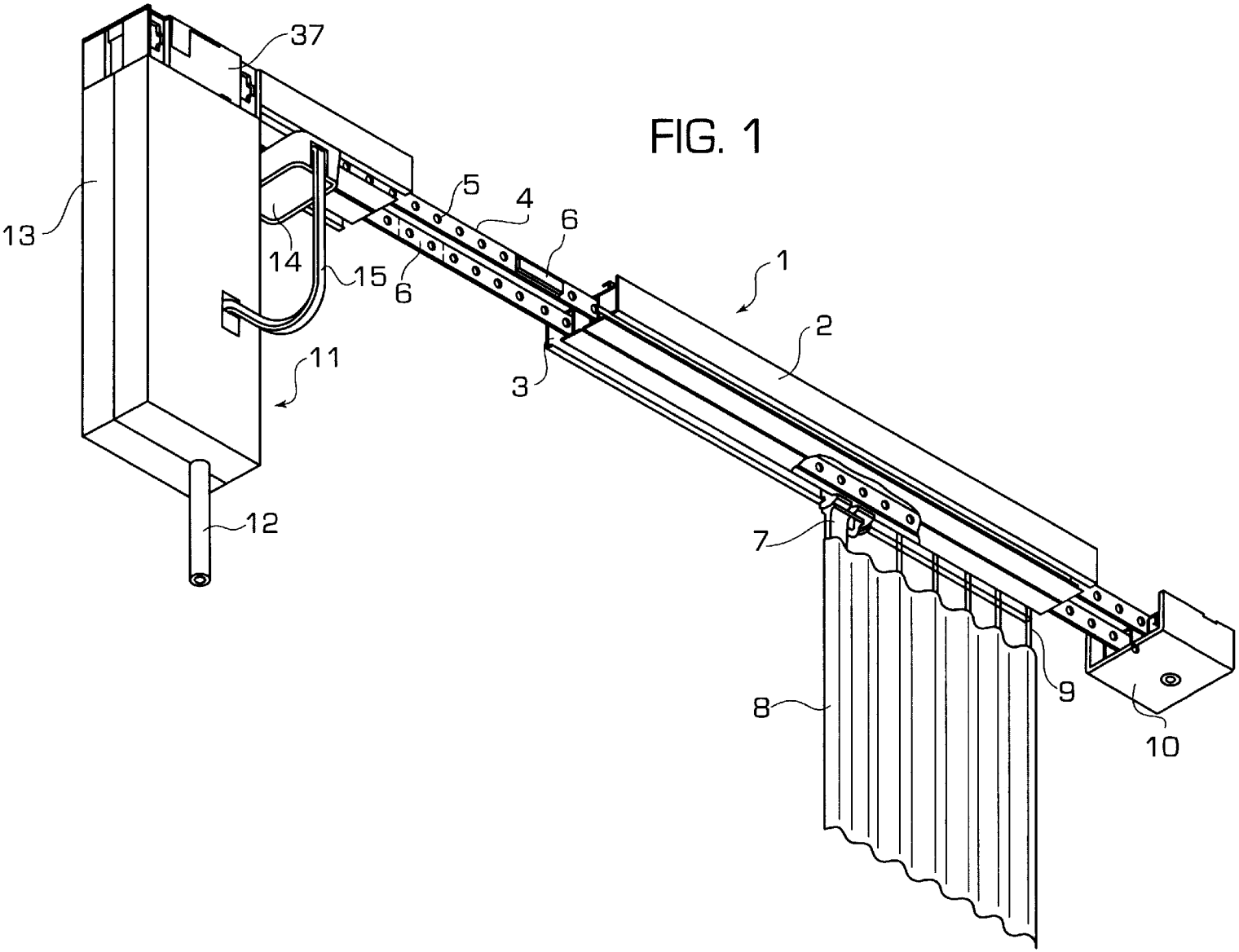
FIG. 1 shows a perspective view of a curtain operating assembly according to the invention, wherein individual sections are shown in partial cutaway.

The curtain operating assembly shown in FIG. 1 consists essentially of an electric motor 11, a track 2 with continuous drive means 4, designed in this case as a perforated drive band, and two end housings 10 and 37 in which the perforated drive band is returned. The assembly 1 aids in the motorized movement of a curtain 8, which is fastened to a carriage 7 and to several slide hangers 9 on a track. The carriage 7 is connected to the perforated drive band 4 and the slide hangers 9 slide in a channel 3.

A non-contact magnetic switch 14 is mounted on the track 2 and is actuated by magnetic plates 6 that are adjustable and are attached to the perforated drive band 4. One of the magnetic plates 6 causes switching when the curtain 8 is open and the other magnetic plate 6 causes switching when the curtain 8 is closed. The desired position can be obtained by moving the magnetic plates 6. The magnetic switch 14 is connected to the electric motor 11 through a control cable, whereby the magnetic switch 14 turns the electric motor 11 on or off depending on the position of the magnetic plates 6. Non-contact magnetic switches 14 are generally known to experts in this field and are therefore not further described.

Figure 3:
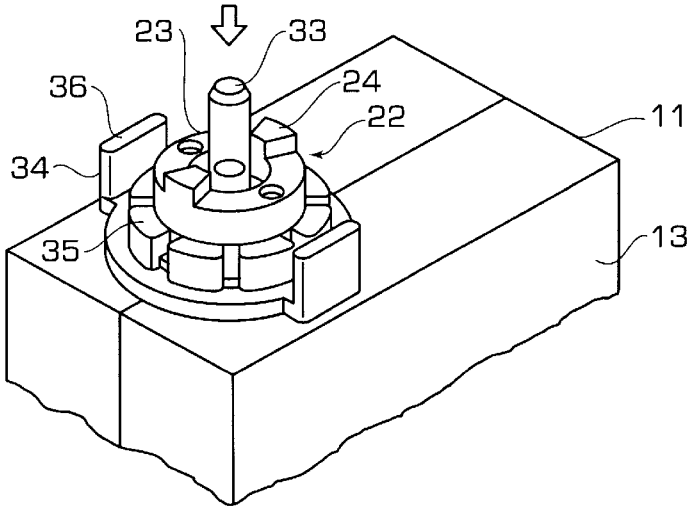
FIG. 3 shows a three-dimensional partial perspective view of the electric motor and a view of a dismounted drive cogwheel.

The electric motor 11 has a housing 13 that is attached to the end or drive housing 37 but which can also be detached. A cable 12 supplies electric power to the electric motor. A cogwheel 17 is located in the drive housing as shown in FIG. 3, for example, and the cogs 18 of the cogwheel 17 are continuously engaged with the perforated drive band 4. The cogwheel 17 has an axial hub 21 through which the drive shaft 33 of the electric motor 11 is installed. The cogwheel 17 is engaged with the drive shaft 37 by means of a claw 22 when the electric motor 11 is turned on. The design and the operation of the claw 22 are described below.

Figure 5:
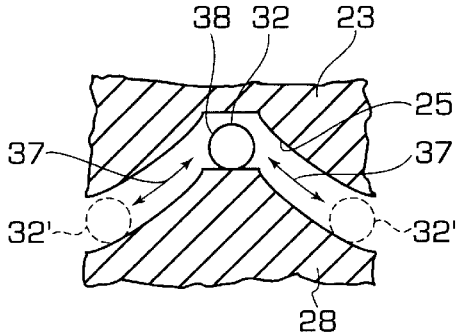
FIG. 5 shows a partial sectional view of the claw.
Figure 5:
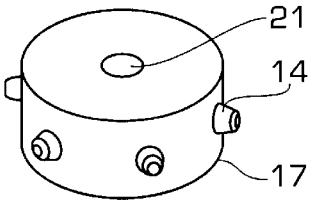
Figure 4:
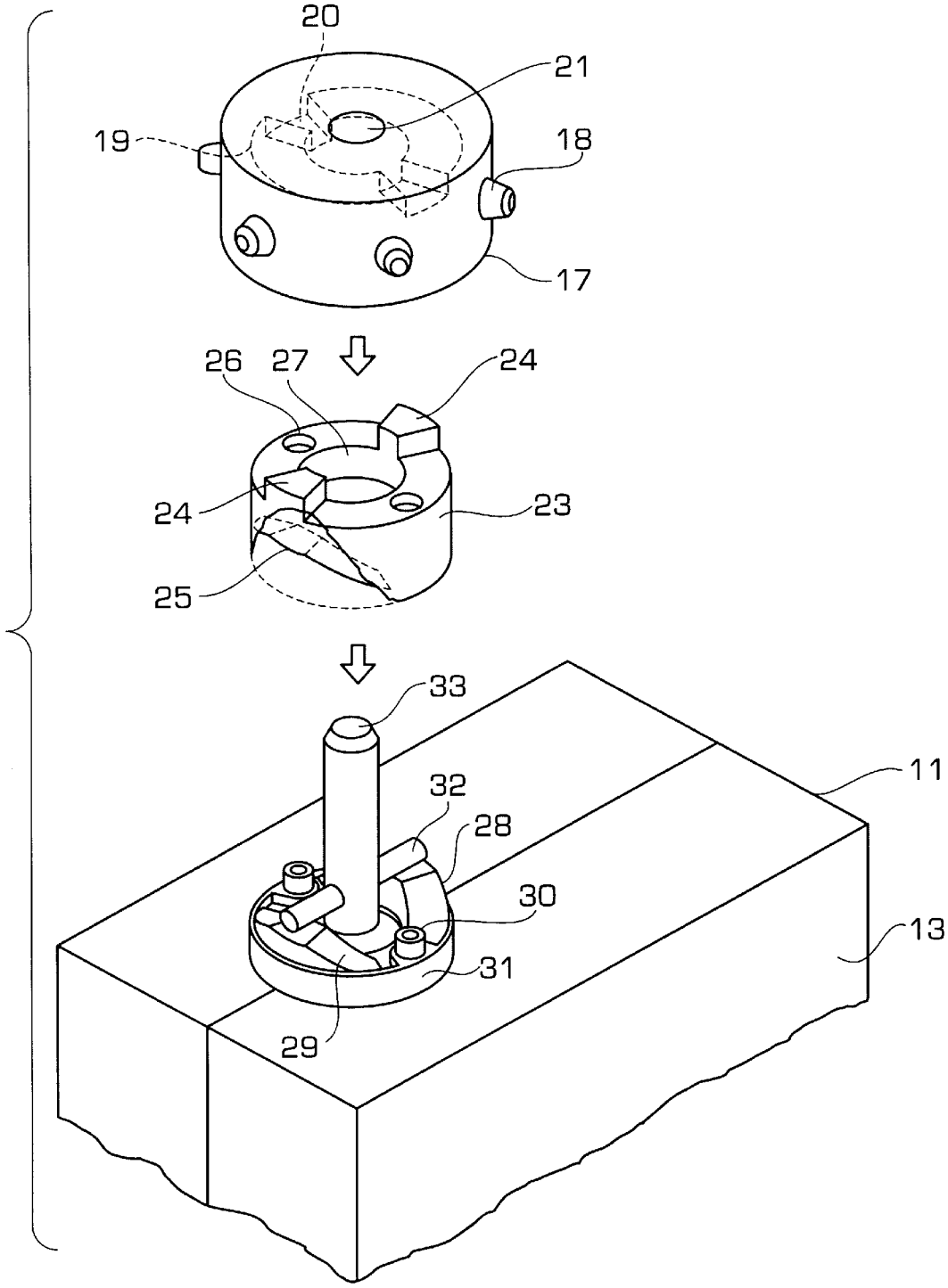
FIG. 4 shows an exploded perspective illustration of the electric motor, the claw and the drive cogwheel.

The claw 22 consists of a lower part 28 and an upper part 23. The lower part 23 has two studs 30 attached at opposite sides from one another and at equal distance, which fit into the corresponding openings 26 of the upper part 23 when assembled. Both parts 28 and 23 remain therefore firmly connected to one another when rotating. Part 28 as well as part 23 have sloping guide surfaces 25 and 29, as shown in FIGS. 4 and 5, which are lined up and are spaced in such a manner that two opposing spaces are formed which come in contact with the ends of pin 32. This pin is fly connected to the drive shaft 33 and turns therefore together with the drive shaft 33 itself.

Figure 2:
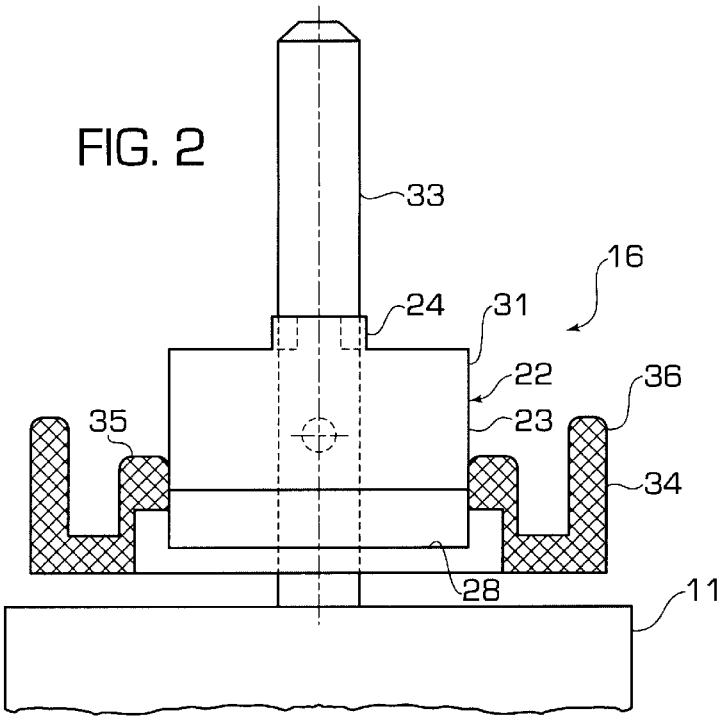
FIG. 2 shows a partial view of an electric motor together with a mounted claw and a sectional view of the brake ring.

A brake ring 34 is placed on the claw 22 as shown in FIG. 3 and this brake ring 34 is firmly connected with the drive housing 37 by two tabs 36. The brake ring 34 has several projections 35, which are elastic and are attached to the outside 31 of the claw 22, as it is clearly shown in FIG. 2.

Whenever the electric motor 11 is turned off, the pin 32 is in a position shown in FIG. 5 by a circle with solid lines. Whenever the motor is turned on, the pin 32 slides to the left or right, as shown in FIG. 5, depending on the rotational direction of the electric motor 11; subsequently the pin 32 slides in the direction indicated by double arrows 37 and into position 32', shown as circles with dotted lines. Thereby the pin 32 slides along the guide surface 25 and pushes the claw 22 against the cogwheel 17. The brake ring 34 prevents rotation of the claw 22 during this axial movement of the claw. The axial movement of the claw 22 is controlled by the tappets 24 of part 23, which lock into the interior recesses of the cogwheel 17. Whenever the drive shaft 37 together with the pin 32 continues to turn in the same direction, then the pin 32 comes into contact with both studs 30 and the claw 22 will now also be turned against the frictional resistance of the brake rings 34. The two tappets 24 that are attached to part 23 come into contact with the two corresponding tappets 20 of the cogwheel 17 and therefore turn the cogwheel. The drive shaft 33 is thereby coupled with the cogwheel 17 and subsequently the perforated drive band 4 is moved and with this the curtain 8 is moved also.

The magnetic switch 14 turns off the electric motor 11 whenever the curtain 8 is in an open or closed position, whereby the drive shaft 33 turns briefly in the opposite direction. The controls for this are well known to experts in this field and are therefore not further explained. The pin 32 moves into the position shown in FIG. 5 with a circle and solid lines during this brief counter-rotation. The guide surface 29 causes the pin 32 to move the claw 22 axially against the housing 11 and thereby the tappets 24 pull out of the recesses 19. Tappets 24 are therefore no longer in contact with the claw 22 and thereby the claw is disengaged. The drive cogwheel 17 can now be turned freely without power from the electric motor 11 and drive shaft 33. The curtain 8 may now be moved manually to any position. Thereby the perforated drive band 4 is moved also along with the drive cogwheel 17 and the idle pulley inside the return housing 10. The frictional resistance of these parts is however relatively low and can be easily overcome. The electric motor 11 may be turned back on at any position of the curtain 8. Thereby the claw 22 reaches into the drive cogwheel 17, as described above, and causes the curtain 8 to move. The electric motor 11 may also be turned off at any position of the curtain and thereby all parts are connected again. In addition, the magnetic switch 14 turns off the electric motor 11 when the curtain reaches the end. The motor 11 is turned off before the curtain is pushed against the stop, where torque would increase. The motor 11 is thus turned off without being stalled at full power at the end of the traversing distance of the curtain 8. A torque increase can be avoided when the curtain 8 reaches its stops and thereby damage can be prevented to all parts, especially the perforated drive band 4. Damage to the drive band 4 may also be prevented by using a relatively high powered motor 11.

What is claimed is:

1. A curtain operating assembly, comprising:

a track (2) that has sliding carriages (7,9) to which a curtain (8) is fastened, said track comprising a pulling band (4) that is connected to the carriages to move the carriages, an electric motor (11) connected to a drive cogwheel (17) which is connected to said pulling band, a clutch mechanism connected between the motor and the drive cogwheel to allow manual control over movement of the curtain;

a drive shaft (33) of the electric motor defining an axial direction; and a claw (22) connected to the drive shaft that moves in the axial direction of said shaft, said switch mechanism comprising an engagement portion of said claw and an engagement portion of said drive cogwheel, and whereby said claw moves in and out of engagement with the drive cogwheel in response to the drive shaft changing rotational direction to thereby engage or disengage the drive shaft.

2. An assembly, according to claim 1, wherein said claw is fitted with a cam (25, 29) for causing an engaging and disengaging of said drive shaft from said drive cogwheel.

3. An assembly, according to claim 2, wherein a pin (32) is placed through said drive shaft, extending on each side thereof, and said pin comes in contact with the cam (25, 29).

4. An assembly, according to claim 3, wherein said claw comprises two assembled parts (23, 28) that have a space (38) in-between where said pin engages.

5. An assembly, according to claim 1, wherein said claw controls axial movement against torsional strain.

6. An assembly, according to claim 5, wherein the claw is mounted in a brake ring (34).

7. An assembly, according to claim 6, wherein said brake ring has tabs (35) which are elastic and are attached to said claw.

8. An assembly, according to claim 1, wherein a non-contact magnetic switch (14) is attached to said assembly and is operative to turn-off said electric motor (11) at predetermined positions of said curtain (8).

9. An assembly, according to claim 8, further comprising at least two adjustable magnetic plates (6) located on said drive band to facilitate switching of said magnetic switch.

10. An assembly, according to claim 8, wherein said electric motor is designed such that it briefly performs a counter-rotational movement whenever it is turned off.

* * * * *